US005597133A

United States Patent [19]

Teague

[11] Patent Number: 5,597,133

[45] Date of Patent: Jan. 28, 1997

[54] ARTICLE DISPENSING APPARATUS AND METHOD

[76] Inventor: Michael Teague, 520 Jose St., #4, Santa Fe, N.M. 87501

[21] Appl. No.: 409,510

[22] Filed: Mar. 23, 1995

[51] Int. Cl.[6] ..... B65H 19/00

[52] U.S. Cl. ..... 242/560.3; 242/596.1; 242/560.2; 221/266; 221/102; 312/34.22

[58] Field of Search ..... 221/248, 249, 221/195, 196, 102, 224, 257, 262, 264, 266, 277; 242/596.1, 558, 559, 560, 560.2, 560.3; 312/34.4, 34.8, 34.16, 34.19, 34.22, 34.24, 45

[56] References Cited

U.S. PATENT DOCUMENTS

| | | | |
|---|---|---|---|
| 2,592,346 | 4/1952 | Scogin | 242/558 |
| 2,603,427 | 7/1952 | Holmes | 242/55.3 |
| 3,130,932 | 4/1964 | Pena | 242/55.3 |
| 3,246,937 | 4/1966 | Galbraith | 312/40 |
| 3,266,742 | 8/1966 | Pena | 242/55.3 |
| 3,374,042 | 3/1968 | Smith | 312/39 |
| 3,421,800 | 1/1969 | Brown | 312/34.22 |
| 3,572,600 | 3/1971 | Jespersen | 242/55.3 |
| 3,580,651 | 5/1971 | Gauper | 312/39 |
| 3,598,331 | 8/1971 | Okamura | 242/55.3 |
| 3,637,276 | 1/1972 | Bump | 312/39 |
| 3,948,454 | 4/1976 | Bastian | 242/55.3 |
| 4,034,924 | 7/1977 | Carlisle | 242/596.1 |
| 4,294,389 | 10/1981 | Falk et al. | 312/34.22 X |
| 4,340,195 | 7/1982 | DeLuca | 242/55.3 |
| 4,383,657 | 5/1983 | Suh | 242/55.3 |
| 4,389,026 | 6/1983 | Willa et al. | 242/55.3 |
| 4,522,346 | 6/1985 | Jespersen | 242/55.3 |
| 4,788,909 | 12/1988 | Stewart | 221/102 X |
| 5,000,393 | 3/1991 | Madsen | 242/560 |

*Primary Examiner*—William E. Terrell
*Assistant Examiner*—Khoi H. Tran
*Attorney, Agent, or Firm*—Deborah A. Peacock; Jeffrey D. Myers; Donovan F. Duggan

[57] ABSTRACT

Disclosed is an apparatus for storing, advancing and replacing paper rolls. The apparatus comprises a vertical magazine for storing paper rolls in a vertical column, a pivotal cradle for advancing the bottom roll while holding back the next following roll, and a cammed-spindle mechanism for replacing a spent spool on a spindle with the bottom roll. A single mechanical impetus accomplishes these functions. Also disclosed is a method of using the apparatus.

17 Claims, 5 Drawing Sheets

ARTICLE DISPENSING APPARATUS AND METHOD

BACKGROUND OF THE INVENTION

1. Field of the Invention (Technical Field)

The invention relates to an apparatus for storing and dispensing flexible web material rolled upon a central hollow core, for example, toilet paper; and a method for using such apparatus.

2. Background Art

The prior art is replete with flexible web and paper roll dispensing devices. The convenience presented by a device which not only dispenses but stores paper rolls, for example, toilet paper, is not to be minimized.

Holmes, U.S. Pat. No. 2,603,427, entitled *Toilet Paper Dispensing Device*, while possessing some automatic functions, still requires at least two manual manipulations to replace a depleted paper roll. U.S. Pat. No. 3,130,932 to Pe ña, entitled *Toilet Tissue Holder and Dispenser*, while purporting to deliver a bottom roll and which the next succeeding roll is a stack, still requires manual placement upon a spindle. The same is true of Peña, U.S. Pat. No. 3,266,742, entitled *Holder Operated Toilet Tissue Magazine and Dispenser.*

U.S. Pat. No. 3,374,042, to Smith, entitled *Toilet Tissue Dispenser*, also requires manual manipulation and mounting of a fresh roll. U.S. Pat. No. 3,598,331, entitled *Toilet Paper Holding Device*, apparently requires special paper cores to ride in guide grooves for replenishment of used rolls. U.S. Pat. No. 3,580,651, to Gaufer, entitled *Toilet Tissue Holding and Dispensing Apparatus*, lacks spindle structure for mounting paper rolls, using rollers instead.

U.S. Pat. No. 3,637,276, to Bump entitled *Dispenser*, merely makes a fresh roll available through a second compartment door when a first roll is depleted. U.S. Pat. No. 4,522,346, to Jespersen, entitled *Method and Apparatus for Dispensing Web Material from Split Core Rolls*, discloses a rather complex mechanism employing special roll core supports that apparently buckle upon depletion of a roll.

U.S. Pat. No. 4,383,657, to Suh, entitled *Dispenser for Products in Sheet Form*, also employs no roll spindles, hence may be wasteful of paper. The same is true of U.S. Pat. No. 4,389,026, to Willa, et al., entitled *Dispensing Container for Rolled Products*. U.S. Pat. No. 3,948,454, to Bastian uses two special spindles to replace a depleted roll. Galbraith, U.S. Pat. No. 3,246,937, uses a hand wheel to drive a gate roller.

None of the prior art, however, discloses a flexible web or paper roll storage and dispensing device wherein a single mechanical impetus is operative to remove a depleted roll from a spindle, advance a fresh roll into dispensing position, and install the fresh roll upon the spindle.

SUMMARY OF THE INVENTION (DISCLOSURE OF THE INVENTION)

The present invention relates to an apparatus and method for storing advancing and replacing roll material comprising means for imparting a single mechanical impetus (e.g., a lever or plurality of levers) to the apparatus; advancing one roll while simultaneously retaining another roll (e.g., via a cradle assembly with two spaced interconnected pivotal supports); and simultaneously replacing a spent roll on a spindle with the one roll (e.g., via one or more flip arm lever assemblies).

The spaced pivotal supports are preferably interconnected by cradle rods eccentrically mounted on the pivotal side supports. The flip lever arm assembly preferably comprises a flip lever arm for laterally camming a spring arm. The spring arm preferably comprises a spindle for mounting the one roll.

The apparatus preferably comprises a vertical magazine for storing a column of rolls in a stacked relationship and may comprise a spent roll receptacle for storage of spent rolls.

A primary object of the invention is the advancement, removal of a depleted roll and installation of a fresh roll of material with a single mechanical manipulation;

Another object of the invention is the storage and dispensation of a plurality of commercial unmodified paper rolls;

Yet another object of the invention is the provision of a simple mechanism for advancing a single fresh roll while retaining rolls not in use;

Still another object of the invention is the provision of a simple mechanism for disposal of a depleted roll from a spindle and installation of a fresh roll upon the spindle;

A primary advantage of the invention is its simplicity and economy of operation;

Another advantage of the invention is its essentially fully automatic operation with a single energy impetus;

Yet another advantage of the operation is its reliability and effectiveness; and Still another advantage of the invention is its ease of manufacture and inexpensive cost of components.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

Figure 1:
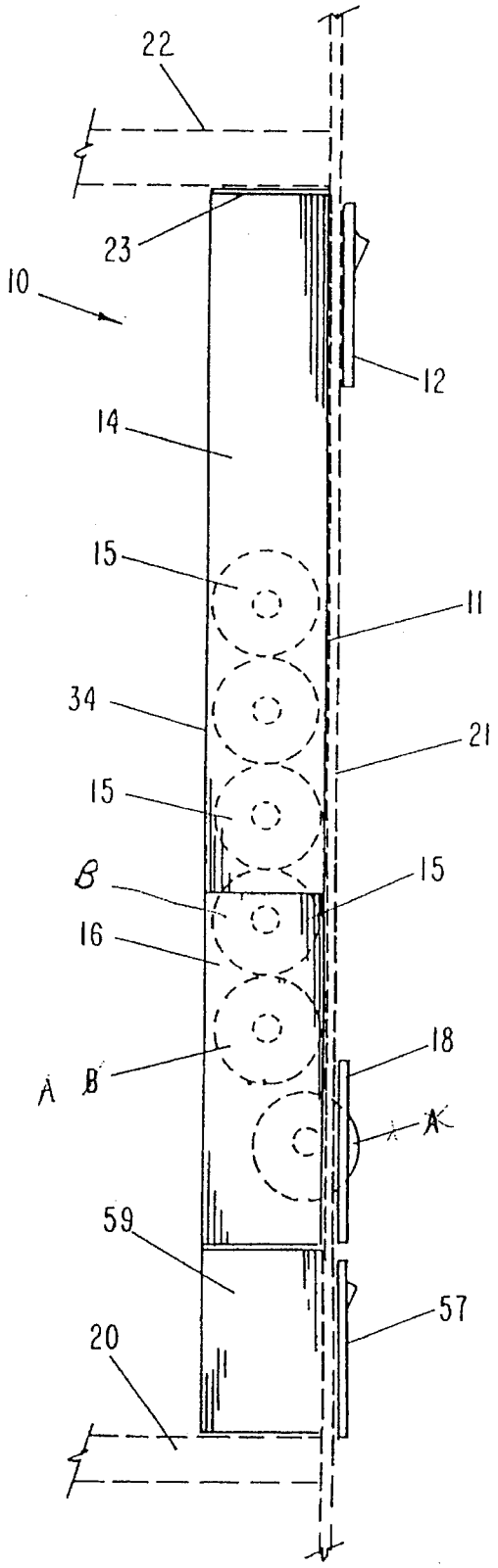
FIG. 1 is a side view of the invention showing rolls in phantom.
Figure 2:
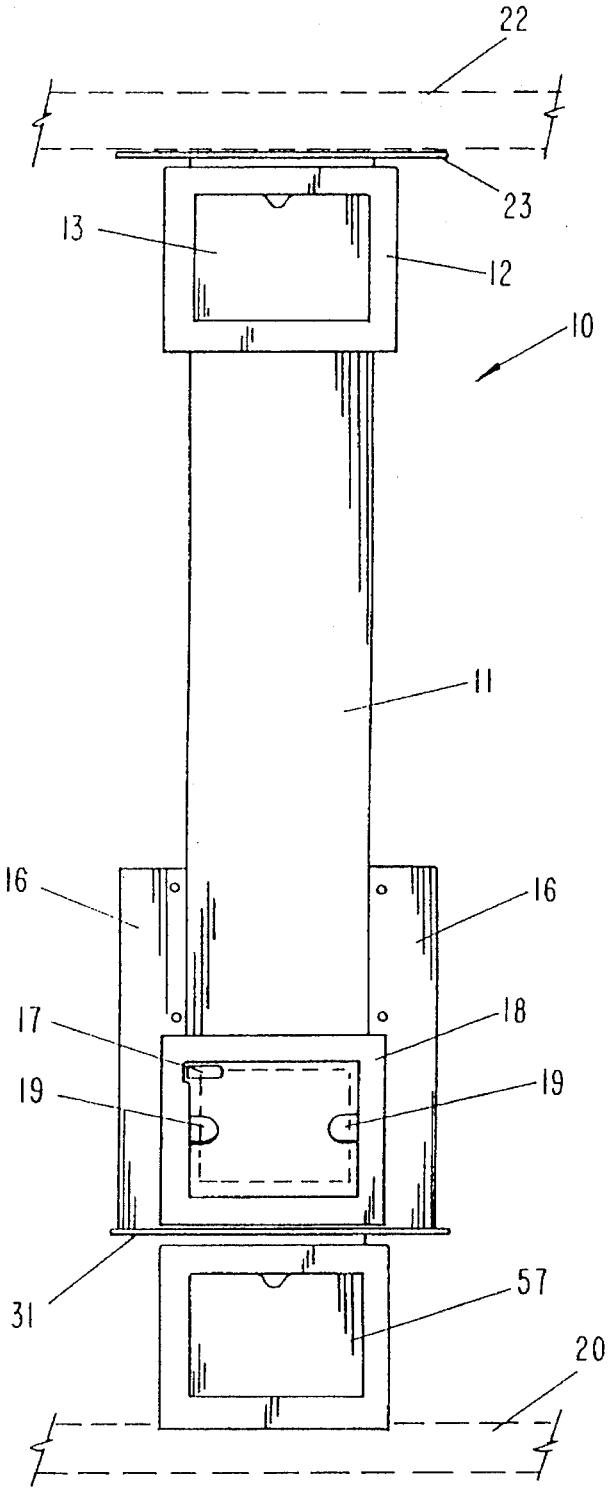
FIG. 2 is a front view of the invention.
Figure 3:
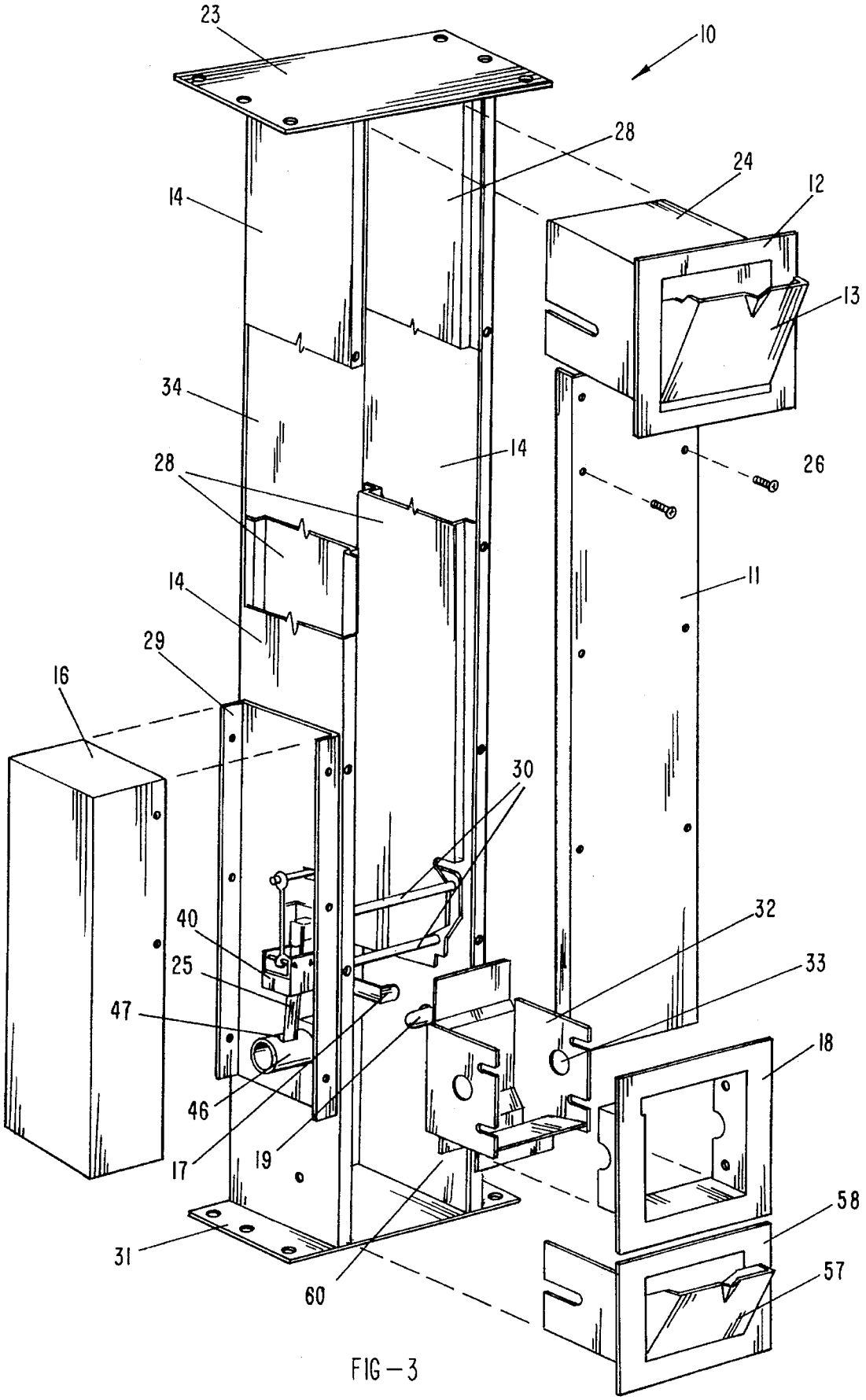
FIG. 3 is an articulated perspective view of the invention.

The preferred embodiment of the invention, best shown in FIGS. 1–3, comprises elongated housing 10 in turn comprising side panels 14, rear panel 34 and front panel 11, all constituting a storage magazine. The apparatus is shown mounted within wall structure 21 between top mounting frame 22 and bottom mounting frame 20, but may, of course, be externally mounted to a wall structure.

The rolls 15 of toilet paper or other flexible web material are loaded into apparatus 10 through loading door 13 which opens outwardly from flanged escutcheon plate 12. While the apparatus can be designed to hold any desired number of rolls 15, as depicted, the apparatus may store a plurality of rolls up to e.g., two to dozens of rolls 15, of toilet paper stacked upon each other. The tissue is dispensed from dispensing compartment 32, flanged and bordered by escutcheon plate 18. Receptacle 59 receives spent spools which can be recovered for disposal through door 57. Inner panels 28 line side panels 14 in spaced relationships.

As best depicted in FIGS. 5–8, cradle assembly 49 comprises the retaining and release mechanism for the bottom rolls A, B and other rolls 15. Cradle assembly 49 further comprises side supports 49' and 49" and two pivotal supports (stub shafts 61 and 61') bearingly (39) mounted between inner panels 28 and side panels 14 for partial rotation about stub shafts 61, 61'. Stub shafts 61, 61' are relatively centrally mounted as pivotal supports for cradle assembly 49. Mounted between side supports 49' and 49" in offset or eccentric relationship to stub shafts 61, 61' is cradle support (e.g., rods 30). Cradle rods 30 may alternatively be a single cradle support assembly (e.g., a cup shape) (not shown). As shown in the figures, (FIG. 7) the first roll loaded into apparatus 10, designated roll A, rests upon and is supported by lower cradle rod 30. Roll B rests upon and is supported by roll A, and, in turn, supports the column of paper rolls 15.

Side supports 49' and 49" further comprise limit slots 51, which together with limit pins 52 (mounted to side panels 14) serve to limit rotational movement of cradle assembly 49.

Also mounted on side supports 49' and 49" are connecting arms 50. Return springs 55 are connected to spring hooks 35 on each connecting arm 50. The other ends of return springs 55 are connected to side cover brackets 127. Lifting rods 36 are attached to and suspend from connecting arms 50; connecting arms 50 are also eccentrically mounted relative to stub shafts 61, 61'.

Actuating lever(s) 17 is rotatably secured to the bottom of the side supports 49' or 49". One or two actuating levers may be utilized; depending upon desired mechanical advantage.

Figure 6:
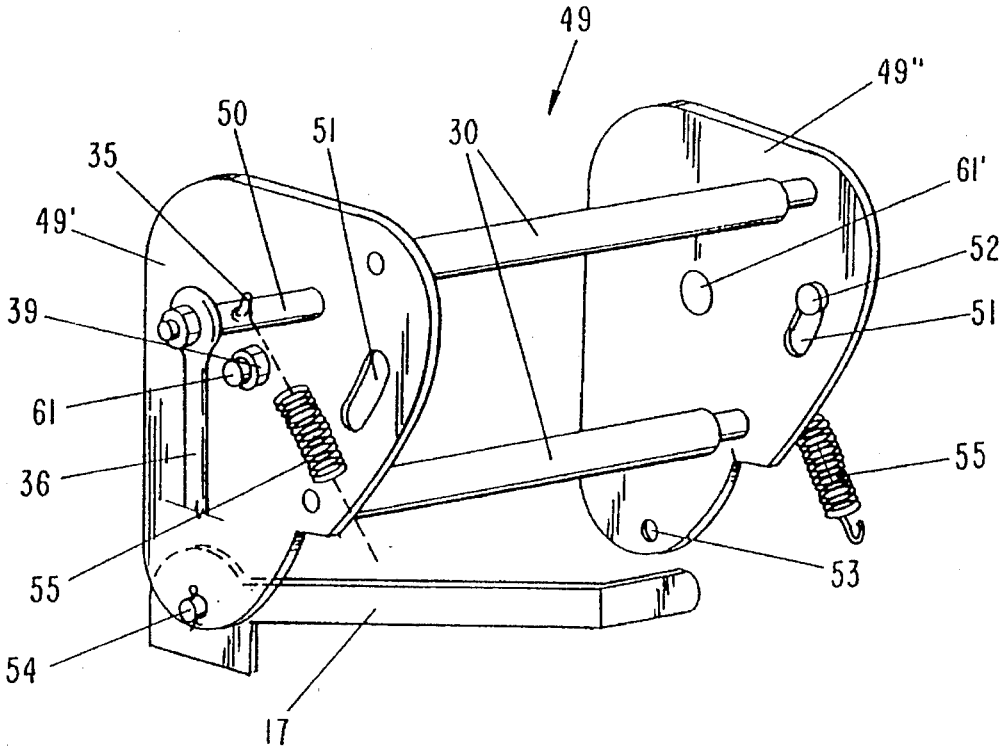
FIG. 6 is a perspective view of the cradle assembly of the invention.
Figure 7:
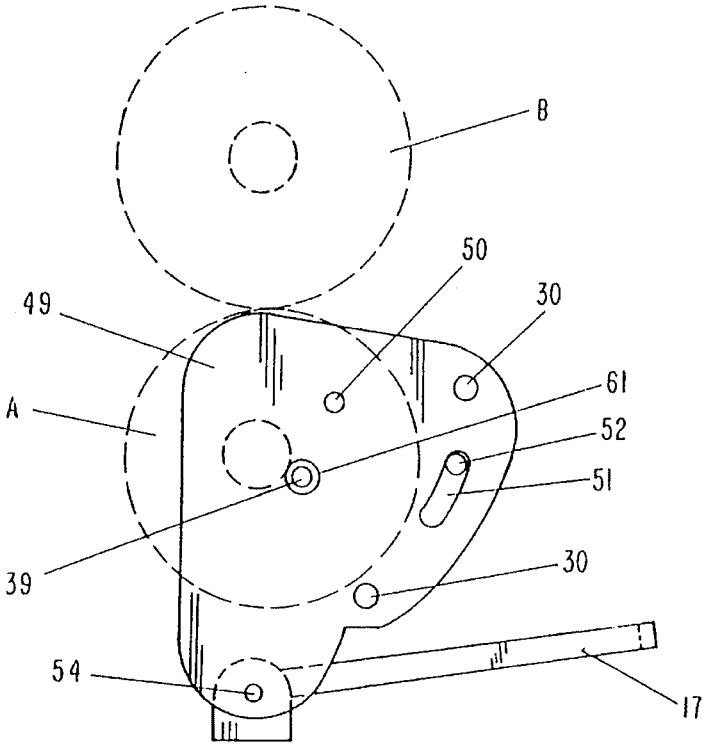
FIG. 7 is a side view of the cradle assembly prior to actuation.
Figure 8:
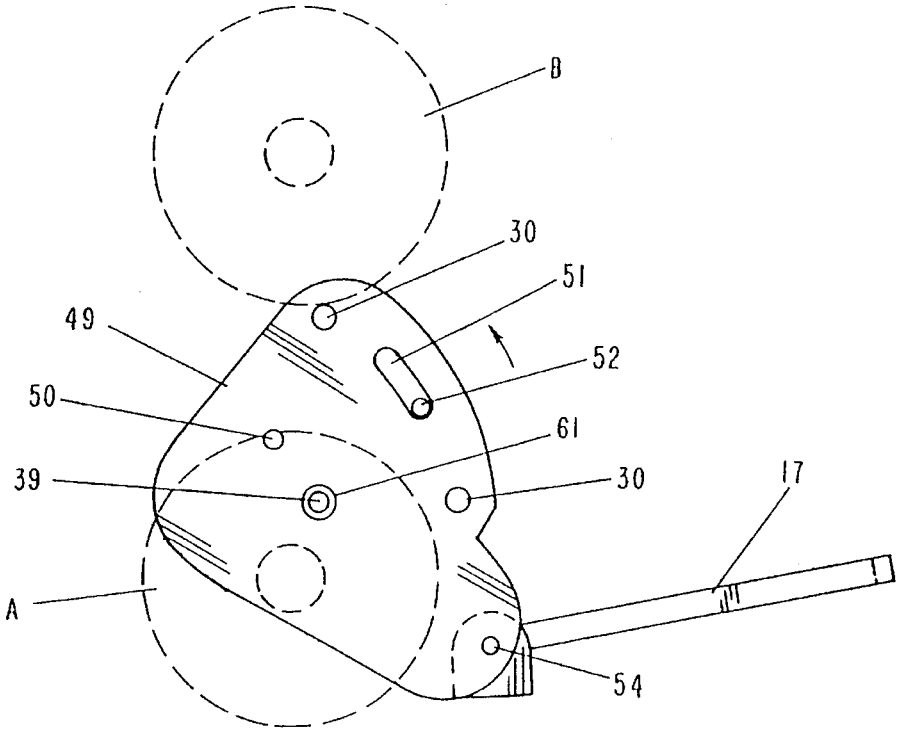
FIG. 8 is a side view of the cradle assembly after actuation.

As best shown in FIGS. 6–8, outward actuation of lever(s) 17 (see FIG. 8) is effective to rotate cradle 49 forward through the arcuate distance represented by limit slot 51. Rotation of cradle 49 moves lower cradle rod 30 out of support contact with roll A, thereby dropping roll A into dispensing chamber 32.

Roll B is then caught and retained by upper cradle rod 30; release of lever(s) 17 permits return springs 55 to rotate cradle 49 back into repose position (FIG. 7); lower cradle rod 30 then engages and retains roll B (which then becomes roll A).

It should also be noted that rotation of eccentrically or offset mounted components 30 and 50 with stub shafts 61, 61' is effective to simultaneously elevate such components above their original repose position, as shown in FIG. 7. This elevational movement is essential for simultaneous operation of flip lever arm assemblies 27.

Figure 4:
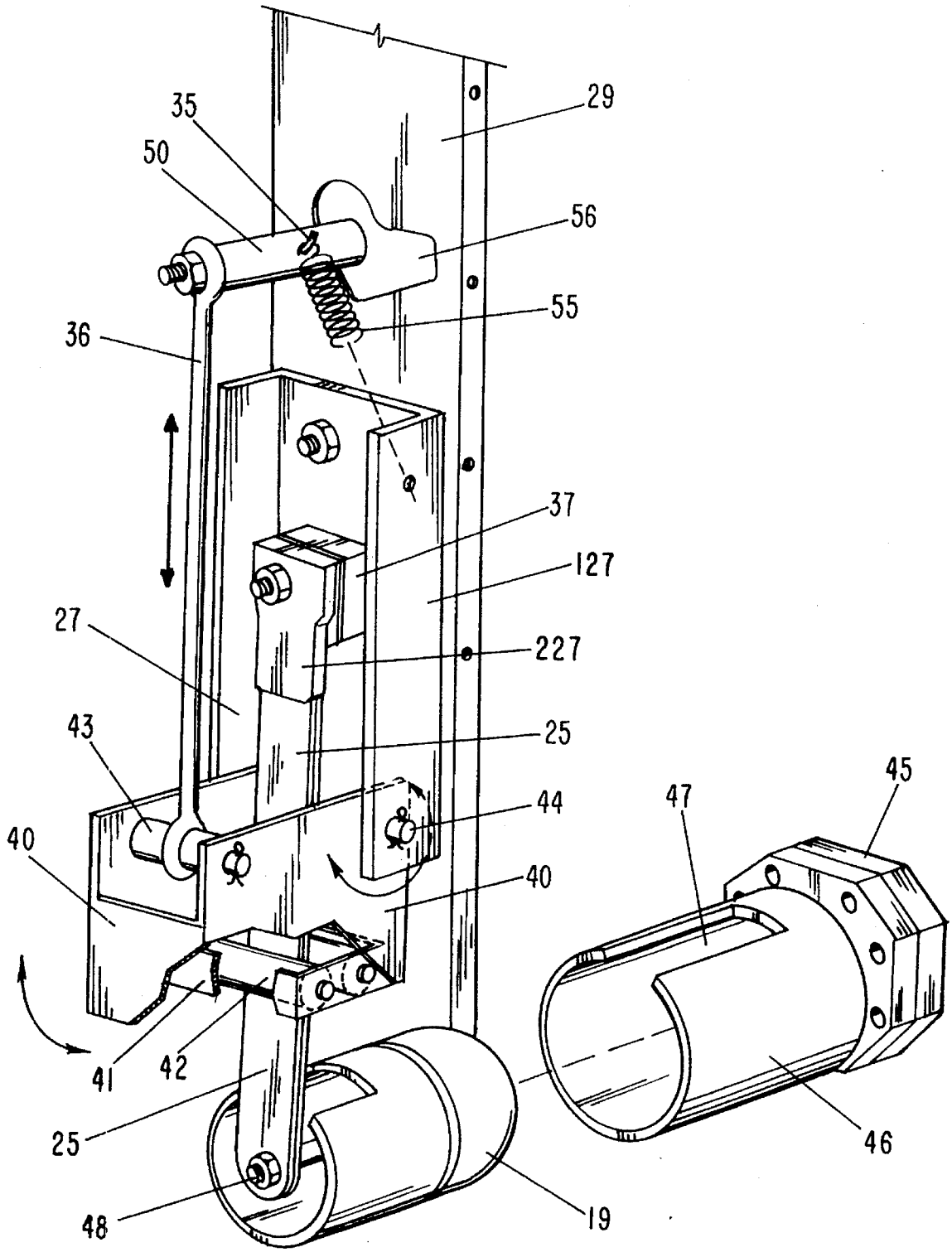
FIG. 4 is a perspective view of the flip arm lever assembly of the invention.
Figure 5:
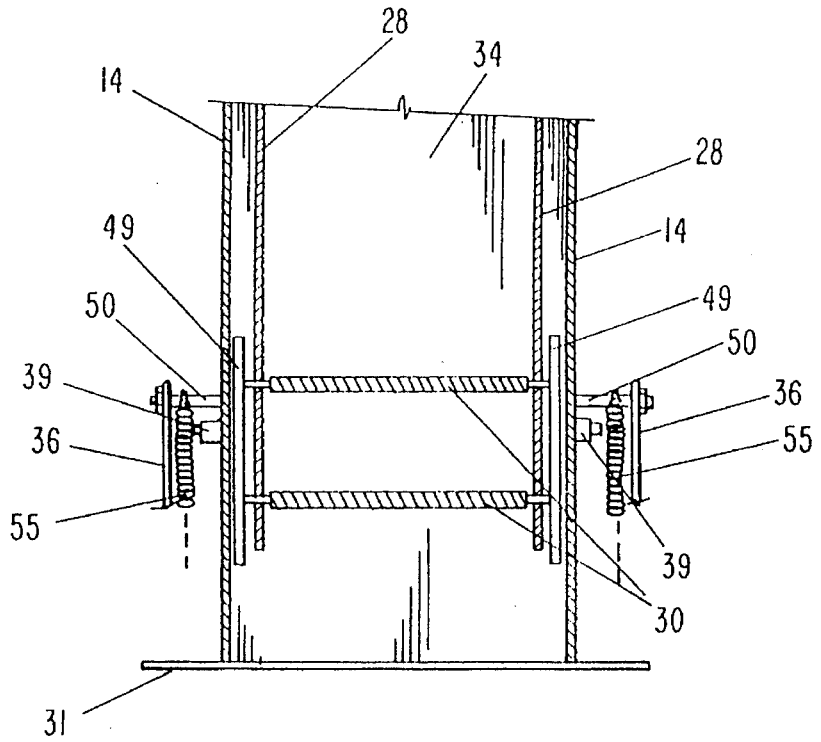
FIG. 5 is a front cutaway view of cradle assembly of the invention.

As best shown in FIGS. 2, 3 and 4, flip lever arm assemblies 27 are mounted below and laterally offset from stub shafts 61, 61'. Flip lever arm assemblies 27 are also mounted in opposing, mirror image configuration relative to each other. Because flip lever arm assemblies 27 are so mounted, description of the operation of only one such flip lever arm assembly follows, it being noted that both flip arm assemblies comprise identical components functioning identically in mirror image configuration to each other. Flip lever arm assemblies 27 comprises flip lever housing 227 which is firmly secured to side cover bracket 127. Flip lever arm 40 is mounted for pivotal movement about pin 44. Flip lever arm 40 further comprises roller bracket 41 mounted therein. Roller bracket 41, in turn, mounts bushings 42 which are freely rotatable independently of each other. Flat leaf spring 25, firmly mounted at one end to flip lever housing 27 and spacer 37, extends downwardly and inwardly at approximately 10° angle from the vertical. Flat spring 25 freely extends between and in contact with bushings 42 and is non-rotatably connected to paper roll spindle 19 at its lower end by spindle mounting nut 48.

Spindles 19 telescopically nest fully within spindle housings 46 when mounting a paper roll in dispensing compartment 32. Leaf spring slots 47 accommodate the lateral movement of leaf springs 25. Spindle housings 46 are firmly mounted to side panel 14. As shown in FIGS. 2–4, spindles 19 oppositely protrude into dispensing compartment 32 and are simultaneously retractable from and positionable into compartment 32 as flip lever arm assemblies 27 are activated.

As noted previously, lifting rod 36 is rotatably mounted on eccentrically mounted connecting arm 50. As cradle 49 is rotated forward, connecting arms 50 are rotated and elevated; lifting rods 36, concomitantly, are also lifted, thereby pivoting flip lever arms 40, brackets 41, and bushings 42. As bushings 42 pivot, they cam leaf springs 25 outwardly, thereby also translating spindles 19 outwardly from spindle housing 46. This motion withdraws both spindles 19 from the spent paper spool, dropping the spent spool through slot 60 into spool receptacle 59 for eventual disposal.

Flip lever arms 40 further comprises lifting rod pins 43 to which lifting rods 36 are rotatably connected. Roll A drops into dispensing compartment 32 when cradle 49 is initially rotated outwardly by actuation of lever 17. Upon release of lever 17, springs 55 return cradle 49 to the FIG. 7 position, thereby catching roll B on lower contract rod 30, which now occupies the position formerly held by roll A.

Rotation of cradle 49 back to its FIG. 7 position also lowers lifting rods 36, pivoting flip arm levers 40 back to their original position, thereby enabling retraction of flat springs 25 and ultimate insertion of roll spindles 19 into roll A.

All of the above described mechanical function occur as a result of a single manipulation (and release) of lever(s) 17. Release of lever(s) 17 also repositions the apparatus for repetition of the entire cycle.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding application(s), are hereby incorporated by reference.

What is claimed is:

1. Apparatus for storing, advancing releasing and replacing roll material comprising:

means for imparting a single mechanical impetus to the apparatus;

means for thereby releasing one roll while simultaneously retaining another roll;

means for thereby sequentially replacing a spent roll on a spindle with said one roll, said means sequentially replacing a spent roll comprising a lever arm assembly comprising a flip lever arm for laterally camming a spring arm comprising an elongated spindle for mounting said one roll; and a spindle housing from which said spindle telescopically and concentrically protrudes when said one bottom roll is mounted and into which said spindle retracts during roll replacement.

2. The invention of claim 1 wherein said means for imparting mechanical impetus comprises a lever.

3. The invention of claim 1 wherein said means for imparting mechanical impetus comprises a plurality of levers.

4. The invention of claim 1 wherein said means for advancing one paper roll while simultaneously retaining another roll comprises a cradle assembly.

5. The invention of claim 4 wherein said cradle assembly comprises two spaced, interconnected side supports.

6. The invention of claim 5 wherein said cradle support is interconnected by cradle rods eccentrically mounted on said side supports.

7. The invention of claim 1 wherein said means for sequintially replacing a spent roll with said one roll comprises a plurality of flip lever arm assemblies.

8. The invention of claim 1 further comprising a spent roll receptacle for storage of spent rolls.

9. An apparatus for storing, advancing and replacing roll material comprising:

a vertical magazine for storing a column of rolls in stacked relationship;

means for applying a single mechanical impetus to the apparatus;

pivotal means for releasing the bottom roll in said column and retaining the next following roll in said column; and lateral camming and elongated spindle means for releasing a spent roll and engaging said next following roll, said elongated spindle means being housed telescopically and concentrically in a spindle housing from which said spindle protrudes when the next following roll is mounted and into which said spindle retracts during spent roll replacement.

10. A process for using an apparatus for storing, advancing and replacing rolls comprising:

a) imparting a single mechanical impetus to the apparatus;

b) thereby releasing one roll while simultaneously retaining another roll by providing a flip arm lever assembly for laterally camming a spring arm comprising an elongated spindle for mounting a paper roll, and providing a spindle housing from which said spindle telescopically and concentrically protrudes when the one roll is mounted and into which said spindle retracts during roll replacement; and c) thereby sequentially replacing a spent roll on the spindle with the one roll.

11. The process of claim 10 wherein the step of imparting a single mechanical impetus comprises providing a lever.

12. The process of claim 10 wherein the step of imparting a single mechanical impetus comprises providing a plurality of levers.

13. The process of claim 10 wherein the step of advancing one paper roll while simultaneously retaining another roll comprises providing a cradle assembly.

14. The process of claim 13 wherein the step of providing a cradle assembly comprises interconnecting two spaced pivotal supports.

15. The process of claims 14 wherein the step of interconnecting two pivotal supports comprises interconnecting the pivotal supports with cradle rods eccentrically mounted on the pivotal supports.

16. The process of claim 10 wherein the step of simultaneously replacing a spent roll with the one roll comprises providing a plurality of flip arm lever assemblies.

17. The process of claim 10 further comprising the step of storing spent rolls.

* * * * *